US008852370B2

(12) United States Patent
Zoni et al.

(10) Patent No.: US 8,852,370 B2
(45) Date of Patent: Oct. 7, 2014

(54) LABELLING MACHINE AND METHOD THEREOF

(75) Inventors: Roberto Zoni, Parma (IT); Carlo Gardani, Parma (IT)

(73) Assignee: SIDEL S.p.A. con Socio Unico (IT)

( * ) Notice: Subject to any disclaimer, the term of this patent is extended or adjusted under 35 U.S.C. 154(b) by 52 days.

(21) Appl. No.: 13/582,649

(22) PCT Filed: Mar. 4, 2010

(86) PCT No.: PCT/IT2010/000095

§ 371 (c)(1),
(2), (4) Date: Nov. 19, 2012

(87) PCT Pub. No.: WO2011/108014

PCT Pub. Date: Sep. 9, 2011

(65) Prior Publication Data

US 2013/0056148 A1 Mar. 7, 2013

(51) Int. Cl.
*B65C 9/46* (2006.01)
*B65C 9/40* (2006.01)

(52) U.S. Cl.
CPC .... *B65C 9/46* (2013.01); *B65C 9/40* (2013.01)
USPC ..... 156/64; 156/277; 156/378; 156/567

(58) Field of Classification Search
CPC ..... B65C 3/065; B65C 9/02; B65C 9/04; B65C 9/06; B65C 9/067; B65C 9/44; B65C 9/46; B65C 9/40; B29C 63/423; G07C 3/14
USPC ..... 156/64, 86, 218, 363, 378, 567, 277
See application file for complete search history.

(56) References Cited

U.S. PATENT DOCUMENTS 4,795,519 A 1/1989 Bullinger
4,844,769 A 7/1989 Kronseder
5,243,532 A * 9/1993 Macchiarulo ..... 156/137

(Continued)

FOREIGN PATENT DOCUMENTS

CN 1330599 A 1/2002
CN 1678497 A 10/2005

(Continued)

OTHER PUBLICATIONS

"International Application Serial No. PCT/IT2010/000095, International Search Report mailed Dec. 1, 2010", 3 pgs.

(Continued)

*Primary Examiner* — Philip Tucker
*Assistant Examiner* — John Blades
(74) *Attorney, Agent, or Firm* — Schwegman Lundberg & Woessner, P.A.

(57) ABSTRACT

There is described a labelling machine for applying a plurality of labels to a respective plurality of articles; the machine comprises a conveying device movable along a given path (P) and having a plurality of operating units for receiving and retaining the articles to be labelled, feeding means for feeding the labels to the operating units, application means for applying the labels to the articles, and a marking unit (100) arranged upstream from the conveying device and comprising means (101) for marking a surface of each label with a mark (M) univocally associable with the corresponding operating unit by which said label shall be received and processed.

8 Claims, 3 Drawing Sheets

(56) References Cited

U.S. PATENT DOCUMENTS

| | | | | |
|---|---|---|---|---|
| 5,508,499 | A * | 4/1996 | Ferrario | 235/375 |
| 5,713,403 | A | 2/1998 | Clusserath et al. | |
| 6,009,733 | A * | 1/2000 | Cheers et al. | 72/17.3 |
| 6,432,528 | B1 | 8/2002 | Faust et al. | |
| 7,870,882 | B2 | 1/2011 | Panzetti | |
| 2004/0003575 | A1 * | 1/2004 | Arends et al. | 53/398 |
| 2007/0071305 | A1 * | 3/2007 | Focke et al. | 382/143 |
| 2009/0294069 | A1 | 12/2009 | Kramer et al. | |

FOREIGN PATENT DOCUMENTS

| | | | |
|---|---|---|---|
| DE | 3110400 | A1 | 10/1982 |
| DE | 4125007 | A1 | 1/1993 |
| DE | 102006025010 | A1 | 11/2007 |
| DE | 102008034744 | A1 | 1/2010 |
| EP | 0325515 | A1 | 7/1989 |
| JP | 2009-202897 | A | 9/2009 |
| KR | 10-0889629 | A | 3/2009 |
| WO | WO-2005/085073 | A1 | 9/2005 |
| WO | WO-2011108014 | A1 | 9/2011 |

OTHER PUBLICATIONS

"International Application Serial No. PCT/IT2010/000095, Written Opinion mailed Dec. 1, 2010", 5 pgs.

"Chinese Application Serial No. 201080065141.1, Office Action mailed Dec. 24, 2013", (w/ English Translation), 18 pgs.

"International Application Serial No. PCT/IT2010/000095, International Preliminary Report on Patentability dated Sep. 4, 2012", 5 pgs.

* cited by examiner

LABELLING MACHINE AND METHOD THEREOF

PRIORITY CLAIM AND RELATED APPLICATIONS

This application is a nationalization under 35 U.S.C. 371 of PCT/IT2010/000095, filed Mar. 4, 2010, and published as WO 2011/108014 A1 on Sep. 9, 2011; which application and publication are incorporated herein by reference in their entirety.

TECHNICAL FIELD

The present invention relates to a labelling machine, in particular a labelling machine of the type forming, e.g. from a heat-shrinkable film, and applying tubular labels to respective articles, such as bottles or generic containers. The following description will refer to this type of labelling machine, although this is in no way intended to limit the scope of protection as defined by the accompanying claims. The present invention also relates to a method for performing the above-mentioned operations.

BACKGROUND ART

As it is generally known, labelling machines are used to apply labels to containers of all sort. Typically used with beverage bottles or vessels are tubular labels (commonly called "sleeve labels"), which are obtainable by:

- cutting the web unwound from a supply roll into a plurality of rectangular or square labels;
- winding each cut label to such an extent that opposite vertical edges of the label overlap; and
- sealing (e.g. welding, or gluing) the overlapping edges, thereby obtaining a corresponding tubular label.

A particular type of labelling machine is known, in which a tubular label is formed on a relative cylindrical winding body (commonly called "sleeve drum"), from which it is subsequently transferred onto a relative container, for instance through insertion of the latter within the tubular label.

This type of labelling machine basically comprises a carousel rotating about a vertical axis and defining a circular path, along which a succession of unlabeled containers and a succession of rectangular or square labels from respective input wheels are fed to the carousel.

The labelling machine shapes the labels in a tubular configuration and applies them onto the respective containers. Finally, the labelling machine releases the labelled containers to an output wheel.

More specifically, the carousel comprises a number of operating units which are equally spaced about the rotation axis, are mounted along a peripheral edge of the carousel and are moved by the latter along the above-mentioned circular path.

Each labelling unit comprises a bottom supporting assembly adapted to support the bottom wall of a relative container and an upper retainer adapted to cooperate with the top portion of such container to hold it in a vertical position during the rotation of the carousel about the vertical axis.

Each supporting assembly comprises a vertical hollow supporting mount, secured to a horizontal plane of a rotary frame of the carousel, and a cylindrical winding body, engaging the supporting mount in sliding and rotating manner with respect to its axis, and adapted to carry a relative container on its top surface and a relative label on its lateral surface.

Each winding body is movable, under the control of cam means, between a raised position and a fully retracted position within the relative supporting mount.

In the raised position, each winding body protrudes from a top surface of the relative supporting mount and is adapted to receive a relative label on its lateral surface from the label input wheel; in particular, the label is wrapped around the winding body such that the opposite vertical edges of the label overlap each other.

In the fully retracted position, which is reached at the container input and output wheels, the top surface of each winding body is flush with the top surface of the supporting mount, so that containers are transferred onto and from the carousel along the same transfer plane.

A number of different techniques may be used for sealing the overlapping edges of the tubular labels, e.g. ultrasound welding, as shown in the International Patent Application No. WO 2005/085073.

After the sealing of the overlapped edges of a tubular label, the movement of the relative winding body from the raised position to the fully retracted position produces the insertion of the relative container inside the label, making the so obtained labelled container ready to be transferred to the output wheel.

The labelled container is then generally fed to a shrinking tunnel (known per se and not shown), where shrinking and adhesion of the label to the external surface of the container is attained.

It must be borne in mind that the function of a label applied on a container is not merely informative. As a matter of fact, the label is not solely intended to bear information concerning the content of the container (e.g. composition, volume content, safety or toxicology data, best-before date and the like) but, possibly through the association with a specific design or trademark which customers have become well-acquainted and familiar with, it contributes to the recognisability of the product and, consequently, to its marketability and commercial success. As a consequence, it is highly desirable that labels be applied to containers with a consistently satisfactory accuracy and homogeneity.

However, labelling machines of the type described above generally form part of plants having a very high throughput, hence the number of tubular labels formed and applied per hour by a single labelling machine may be in the range 24,000-32,000.

Under these conditions, it is almost inevitable that some kind of malfunction affects at some stage the overall labelling process, hence the quality achieved is not fully compliant with the production requirements. A number of different undesirable flaws may be detected, such as lack of proper alignment of the label on the container surface, imprecise or only partial welding/gluing of the overlapping edges of the label, curling or partial tear of a label, etc.

For this reason, labelling machines of the type described above may further comprise a discarding station at which the labelled containers which do not meet the desired quality specifications are identified and, consequently, rejected.

In labelling machines handling heat-shrinkable tubular labels, the discarding machine may be arranged immediately downstream from the carousel and, therefore, upstream from the shrinking tunnel, or, alternatively, downstream from the shrinking tunnel itself. Smaller anomalies and flaws which are not easily detectable prior to the shrinking process shall generally become evident following the application of heat which triggers the shrinking, hence this arrangement may be preferable.

Clearly enough, when detection of a certain flaw becomes recurrent, i.e. when too high a number of labelled containers per unit of time is rejected, it becomes highly likely that a damage or malfunction is affecting some component of the labelling machine.

For the cause of the malfunction to be identified and, much desirably, removed, operation of the labelling machine must be interrupted, so that the different units may be inspected and maintenance or possibly replacing of the malfunctioning unit me be carried out.

As a consequence, the production cycle has to be interrupted and operation of the labelling machine cannot be resumed until the cause of the malfunction has been pinpointed and removed.

Maintenance operations can be particularly complex and time-consuming, especially on labelling machines comprising a large number of operating units. In a field where high throughput is so crucial, any downtime may therefore represent a significant economic loss for the company.

It is therefore highly desirable that the downtime caused by the need to maintain a consistently high quality and accuracy of the label formation and application process be significantly reduced and kept at a minimum.

OVERVIEW DISCLOSURE OF INVENTION

Examples disclosed herein provide a labelling machine designed to achieve the above in a straightforward, low-cost manner.

This is achieved by the present subject matter, according to which there is provided a labelling machine as claimed in claim 1 and a labelling method as claimed in claim 4.

BRIEF DESCRIPTION OF THE DRAWINGS

In the following, a preferred, non-limiting embodiment of the present invention will be described by way of example with reference to the accompanying drawings, in which.

DETAILED DESCRIPTION

Figure 1:
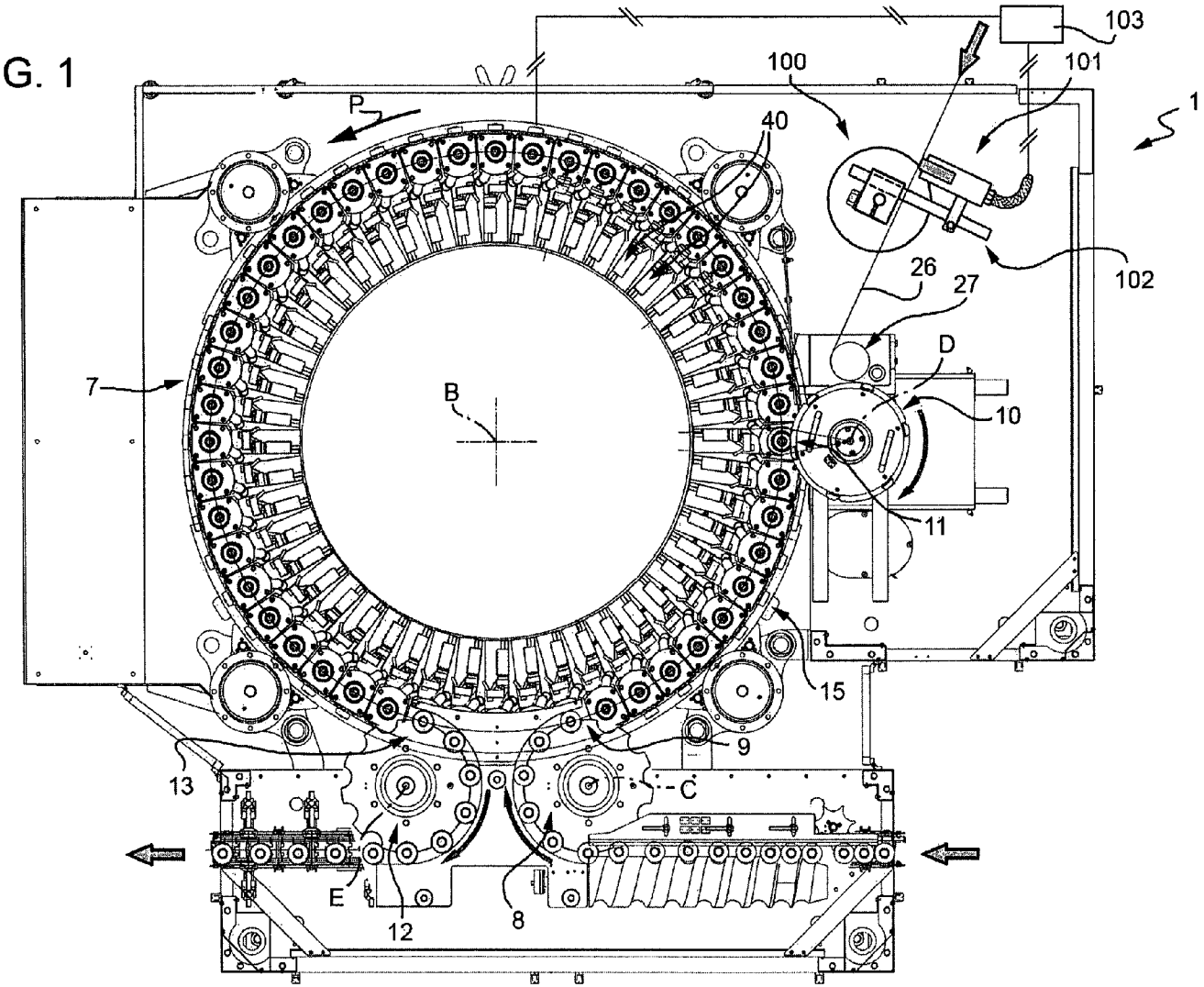
FIG. 1 shows a schematic plan view, with parts removed for the sake of clarity, of a labelling machine in accordance with the teachings of the present subject matter.

Number 1 in FIG. 1 indicates as a whole a labelling machine for applying labels 2 (see FIG. 2) to respective articles or, more specifically, containers, particularly bottles 3, each of which (FIGS. 1 and 2) has a given longitudinal axis A, is bonded at the bottom by a bottom wall 4 substantially perpendicular to axis A, and has a top neck 5 substantially coaxial with axis A.

Machine 1 comprises a conveying device that serves to bend and seal (weld) labels 2 in a tubular configuration (details not shown) and to produce insertion of bottles 3 into the so formed tubular labels 2.

In the preferred embodiment as illustrated in the Figures, the conveying device comprises a carousel 7, which is mounted to rotate continuously (anticlockwise in FIG. 1) about a respective vertical axis B perpendicular to the plane of FIG. 1.

The carousel 7 receives a succession of unlabeled bottles 3 from an input wheel 8, which cooperates with carousel 7 at a first transfer station 9 and is mounted to rotate continuously about a respective longitudinal axis C parallel to axis B.

The carousel 7 also receives a succession of rectangular or square labels 2 from an input drum 10, which cooperates with carousel 7 at a second transfer station 11 and is mounted to rotate continuously about a respective longitudinal axis D parallel to axes B and C.

The carousel 7 releases a succession of labelled bottles 3 to an output wheel 12, which cooperates with carousel 7 at a third transfer station 13 and is mounted to rotate continuously about a respective longitudinal axis E parallel to axes B, C and D.

The carousel 7 comprises a number of operating units 15, which are equally spaced about axis B, are mounted along a peripheral edge of carousel 7, and are moved by carousel 7 along a circular path P extending about axis B and through transfer station 9, 11 and 13.

As shown in FIG. 1, transfer station 11 is arranged, along path P, downstream from transfer station 9 and upstream from transfer station 13.

Figure 2:
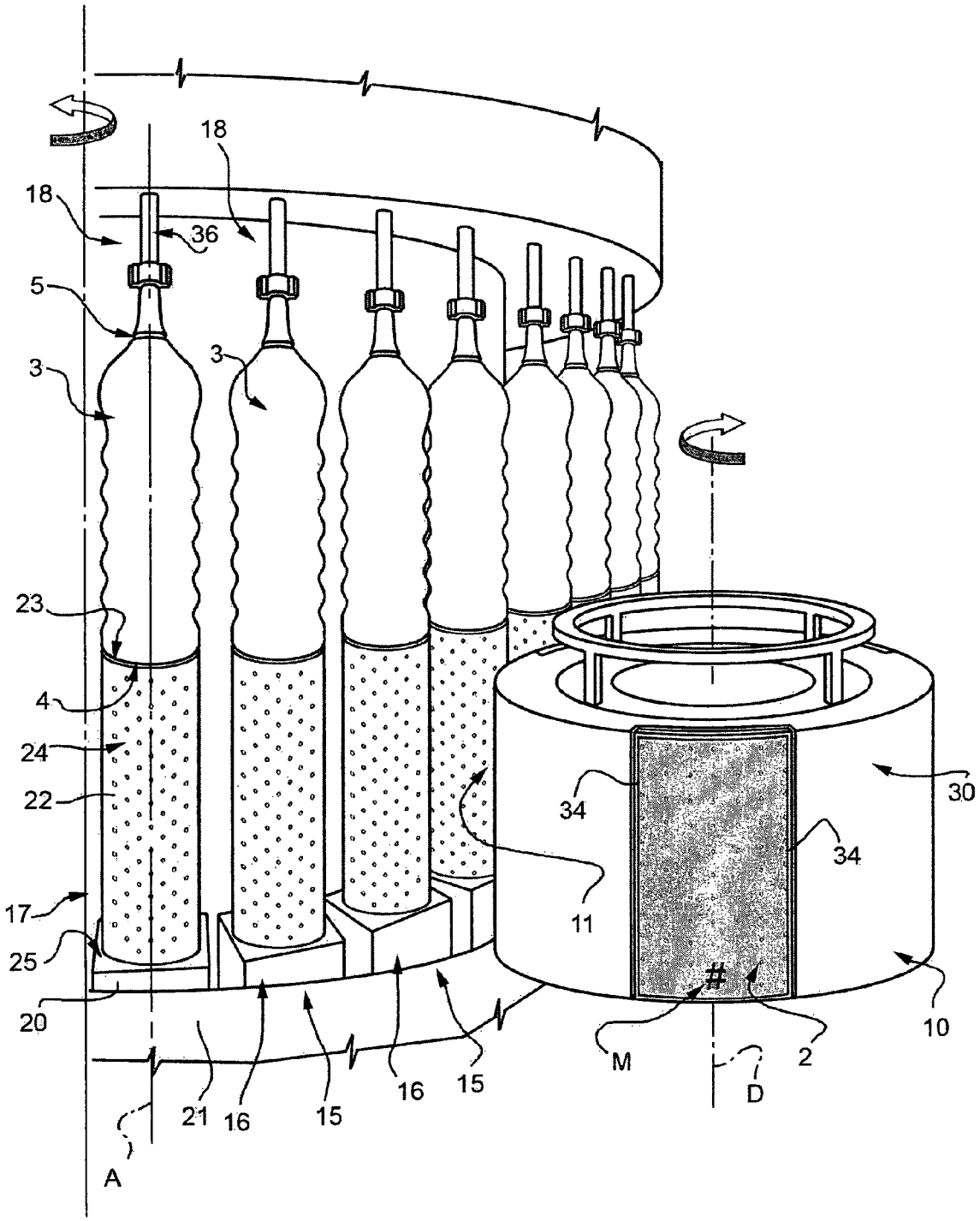
FIG. 2 shows a larger-scale view in perspective of a label transfer portion of the labelling machine of FIG. 1.

With particular reference to FIG. 2, each unit 15 comprises a conveying module 16 adapted to receive a relative bottle 3 from input wheel 8 in a vertical position, i.e. with the relative axis A parallel to axes B, C, D, and to hold said bottle 3 in such position along path P from transfer station 9 to transfer station 13.

Each conveying module 16 comprises a bottom supporting assembly 17 adapted to support the bottom wall 4 of a relative bottle 3 and an upper retainer 18 adapted to cooperate with the top neck 5 of the bottle 3.

In particular, each supporting assembly 17 comprises:

- a hollow supporting mount 20, which has a vertical axis F, parallel to axes B, C, D and E, and is secured to a horizontal plane or table of a rotary frame 21 of carousel 7; and
- a cylindrical winding body 22, engaging the supporting mount 20 in sliding and rotating manner with respect to axis F, and adapted to carry coaxially a relative bottle 3 on its top surface 23 and a relative label 2 on its lateral surface 24.

In particular, each winding body 22 can be moved along axis F in a known manner, under the control of cam means (not shown), between a fully retracted position within the relative supporting mount 20 (not shown) and a raised position (Figure).

In the fully retracted position, each winding body is completely housed within the relative supporting mount 20 so that its top surface 23 is flush with a top surface 25 of the supporting mount 20.

In the raised position (FIG. 2), each winding body protrudes from the top surface 25 of the relative supporting mount 20 and is adapted to receive, on its lateral surface 24, a relative label 2 from input drum 10.

More specifically labels 2 are cut in a know manner from a web 26 (FIG. 1) by a cutting device 27 (only schematically shown in FIG. 1) and fed to input drum 10 to be then transferred to the relative winding bodies 22.

Advantageously, the labelling machine 1 comprises a marking unit 100 for marking the surface of each label 2 with a mark M. As shown in FIG. 1, the marking unit 100 is arranged, along path P, upstream from the cutting device 27.

More particularly, marking unit 100 comprises (see FIG. 3) means 101 for marking the surface of a label 2, such as a write head or a laser system and a support element 102, by which the marking means are supported.

Preferably, the marking means 101 are arranged such as to mark the surface of labels 2 on the side which shall be applied onto containers 3 (see FIG. 2).

Advantageously, the marking unit 100 marks the surface of each label 2 with a distinctive mark univocally associable with the corresponding operating unit 15 by which said label 2 shall be received and processed (i.e. formed into a tubular label, applied to a container, etc.). For example, the marking unit 100 may print on the surface of each label 2 to be fed to a certain operating unit 15 a number univocally corresponding to that specific operating unit 15. Alternatively, the distinctive sign may be a bar-code, a single letter or a combination of letters, etc., provided that a one-to-one correspondence between each mark employed and a single specific operating unit 15 is predetermined and consistently stuck by.

In a first alternative, the one-to-one correspondence is acquired and set during a first cycle of operation of the labelling machine 1. In other words, during the first full rotation of the carousel 7, the marking means 101 mark the surface of a first plurality of labels with a corresponding plurality of distinct marks, each being at once associated with a corresponding operating unit 15. For example, the marking means may mark the labels 3 with progressive numbers from one to N, where N is the overall number of operating units 15 borne by the carousel 7.

Alternatively, the marking unit 100 may advantageously comprise a controller 103 operatively connected with the marking means 101 and the carousel 7 and programmed for managing the operation of the marking means 101 so that they correctly and consistently mark the surface of each label 2 with a distinctive mark univocally associated with the corresponding operating unit 15 by which said label 2 shall be, downstream from the marking unit 100, received and processed.

More particularly, the controller 103 is programmed to receive information concerning the advance sequence of the operating units 15 and of the labels 2 along the path P and to accordingly actuate the marking means 101, so that, in operation, a predetermined one-to-one correspondence between each mark employed and a single specific operating unit 15 is consistently stuck by.

As shown in FIG. 2, the cut and marked labels 2 are retained on a lateral surface 30 of the input drum 10 by suction; in fact, the lateral surface 30 of the input drum 10 is divided into a given number of suction regions, which are equally spaced about axis D, are each provided with a plurality of through holes 32 connected to a pneumatic suction device (known per se and not shown) and are adapted to cooperate with respective labels 2.

In a completely analogous manner, the lateral surface 24 of each winding body 22 is provided with a plurality of through holes 33, in turn connected to a pneumatic suction device (known per se and not shown) so as to retain the relative label 2 by suction.

At the transfer station 11, each winding body 22 can be rotated in a known manner about the relative axis F under the control of relative actuator means (not shown) in order to produce the complete wrapping of the relative label 2, coming from the input drum 10, on lateral surface 24. More specifically, each label 2, fed by the input drum 10, is wrapped around the relative winding body 22 so as to form a cylinder with the opposite vertical edges 34 overlapping each other.

Figure 3:
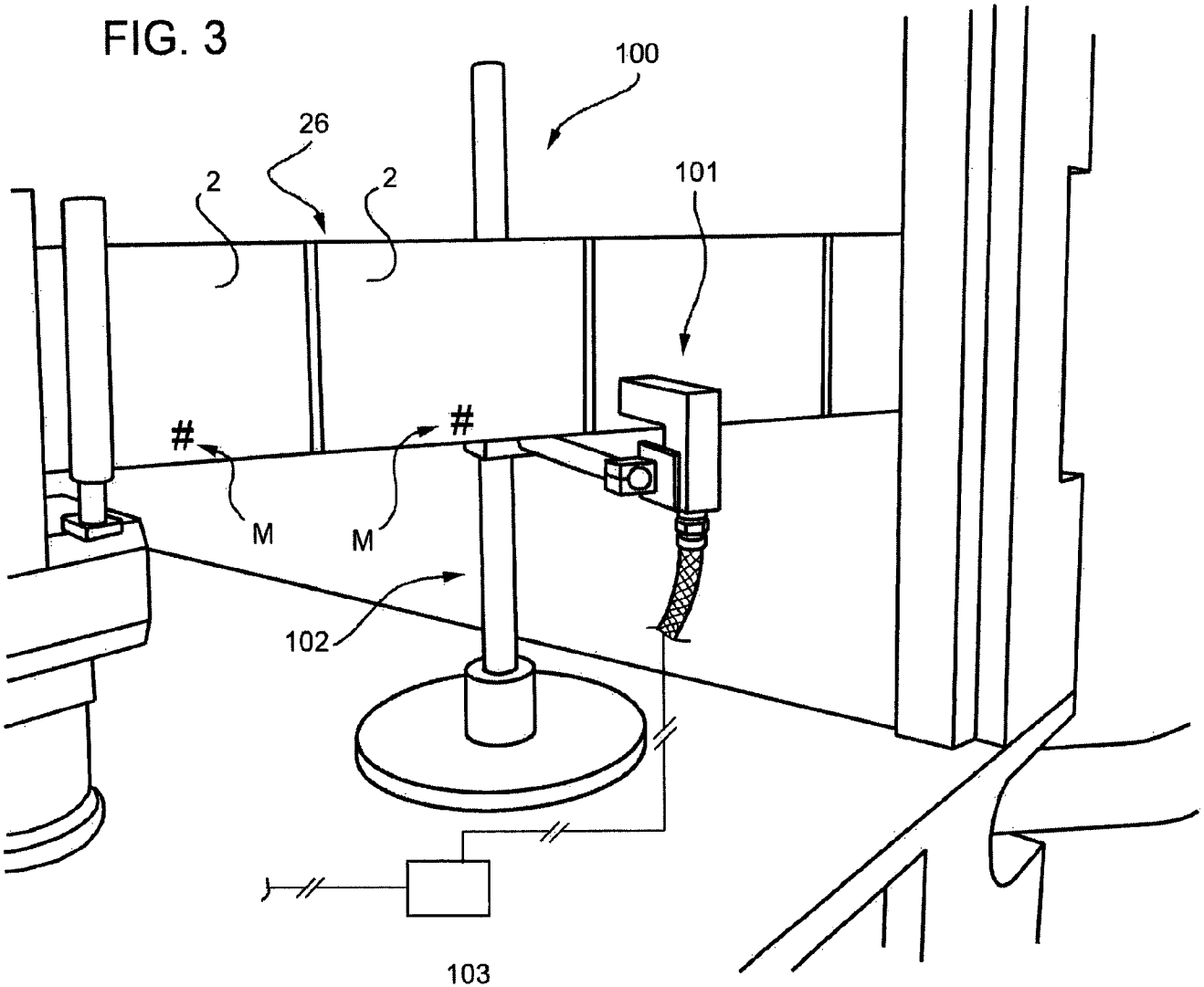
FIG. 3 shows a larger-scale view in perspective of a marking unit of the labelling machine of FIG. 1.

As shown in FIGS. 2 and 3, each retainer 18 comprises, in a known manner, a cylindrical movable member 36, which protrudes vertically from an upper portion of rotary frame 21 of carousel 7, can be displaced along the relative axis F and has a bell-shaped free end portion 37 adapted to cooperate with the top neck 5 of the bottle 3 carried by the corresponding bottom supporting assembly 17.

More specifically, the displacement of each movable member 36 is controlled in a known manner so as to maintain the same distance between its end portion 37 and the top surface 23 of the corresponding winding body 22, during the movement of the relative unit 15 along the portion of path P from transfer station 9 to transfer station 13, and to increase such distance at transfer stations 9, 13 and during the portion of path P from station 13 to station 9. In this way, bottles 3 are securely hold in their vertical positions during the travel from station 9 to station 13 and are free to be transferred at such stations 9 and 13 from input wheel 8 and to output wheel 12, respectively.

With further reference to FIG. 1, each unit 15 further comprises a sealing device 40 (e.g. a welding head) arranged in front of, and in a radially inner position than, the relative conveying module 16 and adapted to cooperate with the label 2 wrapped around the corresponding winding body 22 for sealing the overlapping edges thereof 34, thereby producing a tubular configuration of said label 2.

After completion of the sealing of a tubular label 2, the downward movement of the relative winding body 22 towards the fully retracted position within the relative supporting mount 20 produces the insertion of the relative bottle 3 inside said tubular label. The so formed labelled bottle 3 is then fed to a shrinking tunnel (known per se and not shown), where shrinking and adhesion of the label 2 to the external surface of the bottle 3 occurs.

As described above, the labelling machine 1 may further comprise a discarding unit where the quality of the label formation and application process is checked and any labelled container displaying anomalies or flaws is rejected.

Operation of the labelling machine 1 will now be described with reference to the application of one label 2 on the surface of one bottle 3, and therefore to one specific unit 15.

The label 2 borne by the web 26 is fed to the marking unit 100 where a distinctive mark univocally associable with the corresponding operating unit 15 by which said label 2 shall be downstream received and processed.

Advantageously, the surface of the label 2 is marked with number, bar-code, letter or combination of letter, etc. univocally corresponding to that specific operating unit 15. The controller 103 ensures that a one-to-one correspondence between each mark employed and a single specific operating unit 15 is predetermined and consistently stuck by during operation.

The marked label 2 is subsequently cut by the cutting device 27 and fed to the input drum 10.

With reference to FIG. 2, operation of the labelling machine will now be described as of the instant in which:

- the unlabeled bottle 3 is coaxially arranged on the relative winding body 22 and is held in the vertical position by the combined action of such winding body 22 and the relative upper retainer 18;
- the winding body 22 is in the raised position, ready to receive a relative label 2 from the input drum 10.

At the transfer station 11, the input drum 10 reaches an angular position around axis D adapted to put the label 2 into contact with the winding body 22 passing through such station; thanks to the rotation of winding body 22 around its axis F and to the activation/deactivation of the suction through holes 33, 32, the label 2 is wrapped in a known manner around the winding body 22 and retained thereon. More specifically, the label 2 is wound to assume a tubular configuration with the opposite vertical edges 34 overlapping one another.

At this point, the label 2 is ready to be sealed (e.g. welded) along the edges 34 by activation of the sealing device 40.

Once the welding step is completed, the relative winding body 22 is moved downwards towards its fully retracted position within the relative supporting mount 20, and insertion of the relative bottle 3 inside the tubular label 2 is thereby produced.

The so formed labelled bottle 3 may be fed to a shrinking tunnel where shrinking and adhesion of the label 2 to the external surface of the bottle 3 is finally achieved.

In case any flaw, such as improper alignment of the label 2 on the surface of the container 3, imprecise or only partial sealing (e.g. welding or gluing) of the overlapping edges 34 of the label 2, curling or partial tear of the label 2, is detected, and independently of the stage at which the check is performed (be it upstream or downstream from the shrinking tunnel), it shall appear very likely that the possible cause of the malfunction determining such flaw is to be sought at the operating unit 15 by which said label 2 has been wound, sealed and applied onto the relative container 3.

Since the label 2 has been marked with the mark M, which is univocally associated with one specific operating unit 15, even though operation of the labelling machine 1 has to be interrupted for accessing the operating units 15, an operator shall not need to inspect one after another all the operating units 15 borne by the carousel 7 until he/she finds the one responsible for the malfunction detected. On the contrary, he/she shall check directly the operating unit 15 associated with the mark M borne by the labelled container(s) displaying the flaw.

The advantages of the labelling machine 1 and the relative method according to the present subject matter will be clear from the above description.

Maintenance downtime is significantly reduced, since direct intervention on the part of the operator on the most likely source of malfunction is enabled as a direct consequence of the method of the subject matter.

Accordingly, the labelling machine of the subject matter, which is specifically designed to implement said method, has a significantly improved efficiency, given that prompt identification of the most likely cause of a reduced labelling quality and accuracy is made possible in a straightforward and inexpensive manner. Consequently, maintenance downtime as a whole is cut down, hence expenses are reduced and the overall process productivity may be greatly enhanced.

Clearly, changes may be made to labelling machine 1 and to the method as described and illustrated herein without, however, departing from the scope of protection as defined in the accompanying claims.

The invention claimed is:

1. A method for applying labels to respective articles on a machine comprising a conveying device movable along a given path (P) and having a plurality of operating units to receive and retain a respective plurality of articles to be labelled, said method comprising the steps of:

feeding the labels to said operating units;

applying said labels to said respective articles at said operating units; and marking each label with a mark (M) univocally associable with the corresponding operating unit by which said label shall be received and processed.

2. A method as claimed in claim 1, wherein the step of marking said label comprises the step of preserving, in operation, a specific one-to-one correspondence between each mark (M) employed and a single specific unit.

3. A method as claimed in claim 2, wherein said one-to-one mark (M) to unit correspondence is acquired and set during a first cycle of operation of said machine.

4. A method as claimed in claim 2, wherein said one-to-one mark (M) to unit correspondence is predetermined and stored in a controller.

5. A method as claimed in claim 1, wherein the step of applying said label to said article comprises the steps of:

bending said label in a tubular configuration with an axis (F) transversal to said path (P) and with opposite edges, parallel to said axis (F), which overlap each another; and sealing said overlapping edges of said label.

6. A labelling machine for applying a plurality of labels to a respective plurality of articles, said machine comprising:

a conveying device movable along a given path (P) and having a plurality of operating units to receive and retain the articles to be labelled;

a feeder to feeding the labels to said operating units;

an applier to apply said labels to said articles; and a marking unit arranged upstream from said applier and configured to mark a surface of each label with a mark (M) univocally associable with the corresponding operating unit by which said label shall be received and processed.

7. A labelling machine as claimed in claim 6, wherein said marking unit comprises a controller operatively connected with said marking unit and said conveying device, and programmed to manage the operation of the marking unit so that, in operation, a one-to-one correspondence between each mark (M) employed and a single specific operating unit is consistently preserved.

8. A labelling machine as claimed in claim 6, wherein said applier comprises:

a former to bend said label in a tubular configuration with an axis (F) transversal to said path (P) and with opposite edges, parallel to said axis (F), which overlap each another; and at least one sealing device arranged on said conveying device to seal said overlapping edges of said label.

* * * * *